US006873683B2

(12) United States Patent
Tiwari et al.

(10) Patent No.: US 6,873,683 B2
(45) Date of Patent: Mar. 29, 2005

(54) AXIAL FLUX MOTOR DRIVEN ANODE TARGET FOR X-RAY TUBE

(75) Inventors: Mayank Tiwari, Bangalore (IN); Ramasamy Anbarasu, Bangalore (IN); Mohamed Osama, Niskayuna, NY (US); Gerald Burt Kliman, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 146 days.

(21) Appl. No.: 10/444,236

(22) Filed: May 27, 2003

(65) Prior Publication Data

US 2004/0240614 A1 Dec. 2, 2004

(51) Int. Cl.[7] ..... H01J 35/10
(52) U.S. Cl. ..... 378/131; 378/144; 310/216
(58) Field of Search ..... 378/119, 131, 378/132, 143, 144; 310/261, 266, 267, 268, 216

(56) References Cited

U.S. PATENT DOCUMENTS 5,801,473 A * 9/1998 Helwig ..... 310/254
6,445,105 B1 * 9/2002 Kliman et al. ..... 310/268
6,765,327 B2 * 7/2004 Hashimoto et al. ..... 310/90
6,803,694 B2 * 10/2004 Decristofaro et al. ..... 310/216

FOREIGN PATENT DOCUMENTS

EP 0729663 9/2002

* cited by examiner

*Primary Examiner*—Craig E. Church
*Assistant Examiner*—Irakli Kiknadze
(74) *Attorney, Agent, or Firm*—Patrick K. Patnode; Christian G. Cabou

(57) ABSTRACT

An X-ray tube comprises a cathode, an anode target assembly and an axial flux motor having a rotor and a stator. The stator is positioned along a transverse axis parallel to the rotor axis. The rotor and the stator are configured to be coupled to the anode target assembly. A cathode generates an electron beam for impingement upon the anode target assembly and a vacuum housing surrounds the anode target assembly, the cathode and the rotor to enable the electron beam impingement.

52 Claims, 12 Drawing Sheets

AXIAL FLUX MOTOR DRIVEN ANODE TARGET FOR X-RAY TUBE

BACKGROUND OF INVENTION

The present invention relates generally to X-ray generation systems and more specifically to X-ray tubes driven by axial flux motors.

An X-ray tube comprises an electron beam emitted from a cathode to strike an anode target assembly for producing X-rays. The electron beam is accelerated by a potential difference maintained between the cathode and the anode target assembly, typically on the order of about 60 kilovolts to about 140 kilovolts. The accelerated electron beam hits an anode target at a focal spot, generating the X-ray radiation thereby. Typically, only about one percent of the kinetic energy of the electron beam is converted to X-ray radiation. The remaining portion of the kinetic energy of the electron beam is converted to thermal energy. It is desirable to rotate the anode target assembly by a drive arrangement at a desired speed, to avoid local melting of the anode target assembly.

In conventional X-ray generation systems, the X-ray tube anode target assembly is driven by an induction motor, typically a radial flux induction motor. Such X-ray tube having the anode target assembly driven by the radial flux motor is typically characterized by a substantially long axial span caused due to typical mass distribution of the rotating components. Such rotating components include, for example, a rotor of the radial flux machine and the anode target assembly. The bearings supporting the rotating components are thus spaced apart from each other by a substantially long distance. Such bearings experience excess mechanical load, such as static load and dynamic load, due to excess weight and centrifugal force of the rotating components, respectively. Furthermore, the bearings are exposed to a substantial thermal load, generated due to impingement of the electron beam on the anode target assembly. The mechanical load coupled with such thermal load experienced by the bearings poses a challenge to X-ray tube designers, particularly with regard to enhancing the bearing life so as to ensure trouble free operation of the X-ray generation system.

Although certain methods have been used to minimize the thermal load on X-ray tube bearings, issues pertaining to excess static load and dynamic load experienced by the bearings continue to pose a challenge to X-ray tube designers. The typical mass distribution of the rotating components poses additional limitations on design of X-ray generation systems, particularly with regard to minimizing weight and improving overall compactness of the X-ray tube.

Accordingly, there is a need in the art to design an X-ray tube that minimizes static and dynamic load on the bearings to achieve enhanced bearing life, minimize weight of the X-ray generation system and improve system reliability.

BRIEF DESCRIPTION

Briefly, in accordance with one embodiment of the present invention, an X-ray tube comprises an anode target assembly and an axial flux motor having a rotor and a stator. The stator is positioned along a transverse axis parallel to the rotor axis. The rotor and the stator are configured to be coupled to the anode target assembly. A cathode generates an electron beam for impingement upon the anode target assembly and a vacuum housing surrounds the anode target assembly, the cathode and the rotor to enable the electron beam impingement.

In accordance with another embodiment, an X-ray tube comprises an anode target assembly and an axial flux induction motor having a rotor and a stator. The rotor comprises a ferromagnetic disc. The stator is positioned along a transverse axis parallel to the rotor axis. The rotor and the stator are configured to be coupled to the anode target assembly. The axial flux induction motor further comprises a bearing assembly having at least two bearings and at least one bearing mount to support the rotor. The anode target assembly is positioned before a first bearing and a second bearing of the at least two bearings. A cathode generates an electron beam for impingement upon the anode target assembly and a vacuum housing surrounds the anode target assembly, the cathode and the rotor to enable the electron beam impingement. The stator is positioned within the vacuum housing.

In accordance with another embodiment, an X-ray tube comprises an anode target assembly and an axial flux induction motor having a rotor and a stator. The rotor comprises a ferromagnetic disc. The stator is positioned along a transverse axis parallel to the rotor axis. The rotor and the stator are configured to be coupled to the anode target assembly. The axial flux induction motor further comprises a bearing assembly having at least two bearings and at least one bearing mount to support the rotor. The anode target assembly is positioned before a first bearing and a second bearing of the at least two bearings. A cathode generates an electron beam for impingement upon the anode target assembly and a vacuum housing surrounds the anode target assembly, the cathode and the rotor to enable the electron beam impingement. The stator is positioned outside the vacuum housing.

In accordance with another embodiment, an X-ray tube comprises an anode target assembly and an axial flux induction motor having a rotor and a stator. The rotor comprises a ferromagnetic disc. The stator is positioned along a transverse axis parallel to the rotor axis. The rotor and the stator are configured to be coupled to the anode target assembly. The axial flux induction motor further comprises a bearing assembly having at least two bearings and at least one bearing mount to support the rotor. The anode target assembly is positioned between at least a first bearing and a second bearing of the at least two bearings. A cathode generates an electron beam for impingement upon the anode target assembly and a vacuum housing surrounds the anode target assembly, the cathode and the rotor to enable the electron beam impingement. The stator is positioned within the vacuum housing.

In accordance with another embodiment, an X-ray tube comprises an anode target assembly, an axial flux induction motor having a rotor and a stator. The rotor comprising a ferromagnetic disc. The stator is positioned along a transverse axis parallel to the rotor axis. The rotor and the stator are configured to be coupled to the anode target assembly. The axial flux induction motor further comprises a bearing assembly having at least two bearings and at least one bearing mount to support the rotor. The anode target assembly is positioned between at least a first bearing and a second bearing of the at least two bearings. A cathode generates an electron beam for impingement upon the anode target assembly and a vacuum housing surrounds the anode target assembly, the cathode and the rotor to enable the electron beam impingement. The stator is positioned outside the vacuum housing.

In accordance with another embodiment, an X-ray tube comprises an anode target assembly and an axial flux induction motor having a rotor and a stator. The stator is positioned along a transverse axis parallel to the rotor axis while the rotor is further configured to be integral with the anode target assembly. The axial flux induction motor further comprises a bearing assembly having at least two bearings and at least one bearing mount to support the anode target assembly. The anode target assembly is positioned between at least a first bearing and a second bearing of the at least two bearings. A cathode generates an electron beam for impingement upon the anode target assembly and a vacuum housing surrounds the anode target assembly and the cathode to enable the electron beam impingement.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
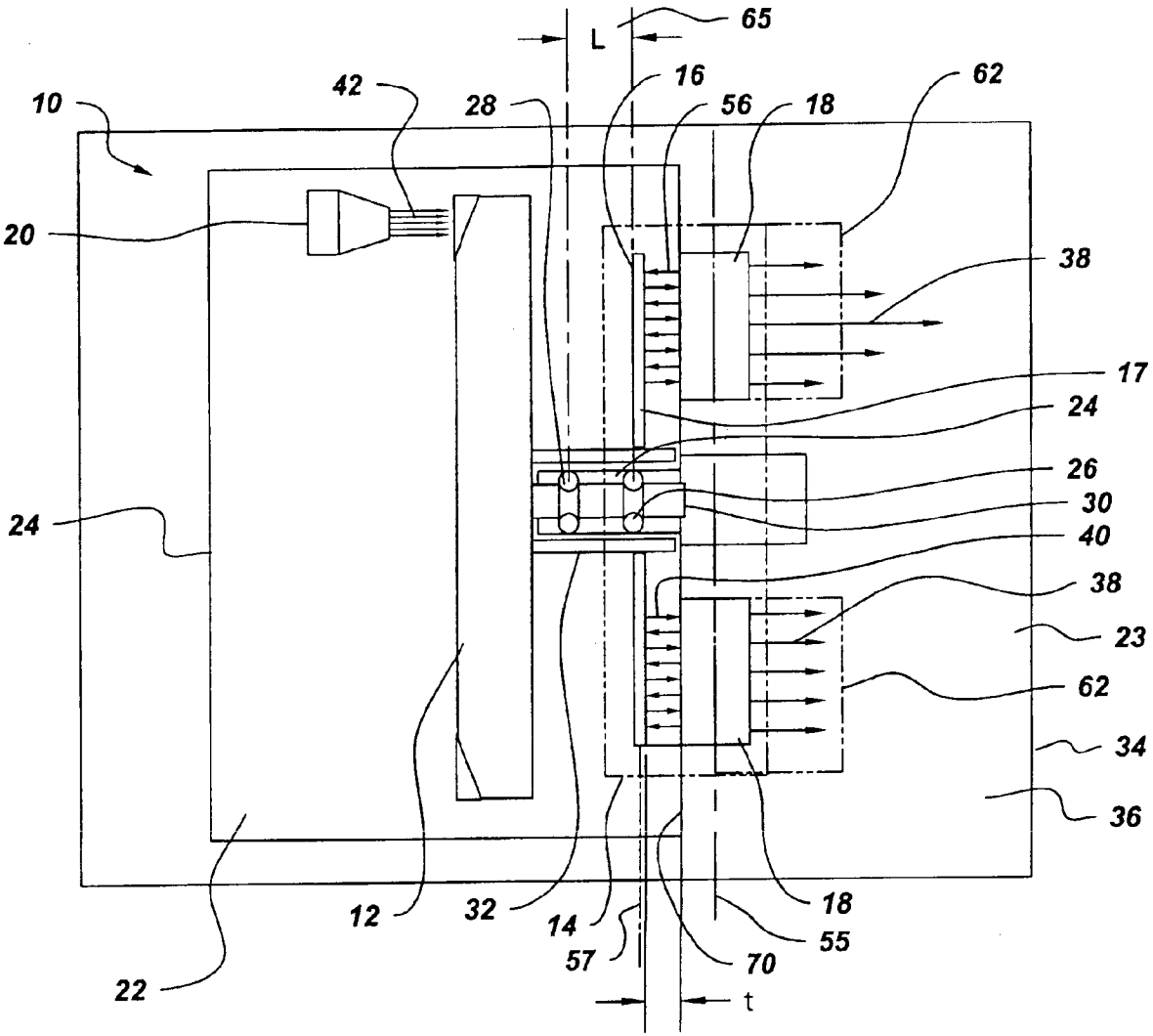
FIG. 1 is an exemplary arrangement of an X-ray tube showing an anode target assembly driven by an axial flux motor according to one embodiment of the invention.

An X-ray generating device, also referred to as an X-ray tube 10, is depicted in FIG. 1 through FIG. 6. The X-ray tube 10 includes an anode target assembly 12. The anode target assembly 12 is generally fabricated from a metal having a relatively large atomic number such as tungsten or tungsten alloy, molybdenum or rhenium, for example. A cathode filament (not shown) disposed in a cathode assembly 20, is heated to emit an electron beam 42. A potential difference, typically on the order of about 60 kilovolts to about 140 kilovolts, is applied between the cathode assembly 20 and the anode target assembly 12 to accelerate the electron beam 42 generated by the cathode assembly 20. Once accelerated, the electron beam. 42 impinges on the anode target assembly 12 to generate electromagnetic radiation. Such electromagnetic radiation is typically X-ray radiation.

A portion of the kinetic energy of the electron beam 42, typically about 1%, is converted to the X-ray radiation, while the balance is converted to thermal energy. It is desirable to rotate the anode target assembly 12 by a drive arrangement at a desired speed so as to avoid local melting of the anode target assembly 12 when impinged by the electron beam 42. A vacuum housing 22, typically constructed of glass or metal, surrounds the anode target assembly 12 and the cathode assembly 20. Such vacuum housing 22 prevents possible collision of the electron beam 42 with gas or fluid molecules. Preventing such collision of the electron beam 42 with gas or fluid molecules eliminates interference in the X-ray generation process. Further, the vacuum housing 22 is disposed within a shield 34 to prevent X-ray radiation leakage. A heat dissipating fluid 36, such as oil, is disposed within the space 23 between the vacuum housing 22 and the shield 34 and aids in dissipating heat generated by the X-ray tube 10.

Conventional X-ray tube drive arrangements include radial flux motors. Such conventional X-ray tube drive arrangements are characterized by typical mass distribution of a cylindrical shaped rotor and a cylindrical shaped stator disposed in concentric arrangement with the cylindrical shaped rotor, to define a radial gap therebetween. As may be appreciated, such mass distribution of the drive arrangement of the conventional X-ray tubes results in substantially long bearing span across axial direction. Such substantially long bearing span disadvantageously induces excess mechanical load such as a static load and a dynamic load on the bearings supporting rotating components of the X-ray tube driven by the radial flux motor. Moreover, typical mass distribution of the drive arrangement of the X-ray tubes driven by such radial flux motors, adversely affect balance of mechanical load distribution between the bearings supporting the rotating components thereof.

As will be apparent from discussion in subsequent paragraphs, the drive arrangement of the X-ray tube 10 has been designed in accordance with the present technique to address such disadvantages. Typical drive arrangement of the X-ray tube 10 according to certain embodiments of the present technique includes an axial flux motor 14 having a rotor 16 and stator 18. As depicted in FIG. 1 through FIG. 6, the stator 18 is positioned along a transverse axis 55 parallel to the rotor axis 57. As depicted further in FIG. 1 through FIG. 6, a magnetic flux 40 induced in the axial flux motor 14 travels axially from the rotor 16 to the stator 18 through the gap 56 defined by the rotor 16 and the stator 18 and returns axially to the rotor 16 in a closed loop configuration. An alternating current in the stator 16 interacts electro-magnetically with the magnetic flux 40 induced in the gap 56 to generate a driving torque thereby. The driving torque turns the rotor 16 coupled with the anode target assembly 12 at a desired speed.

Figure 7:
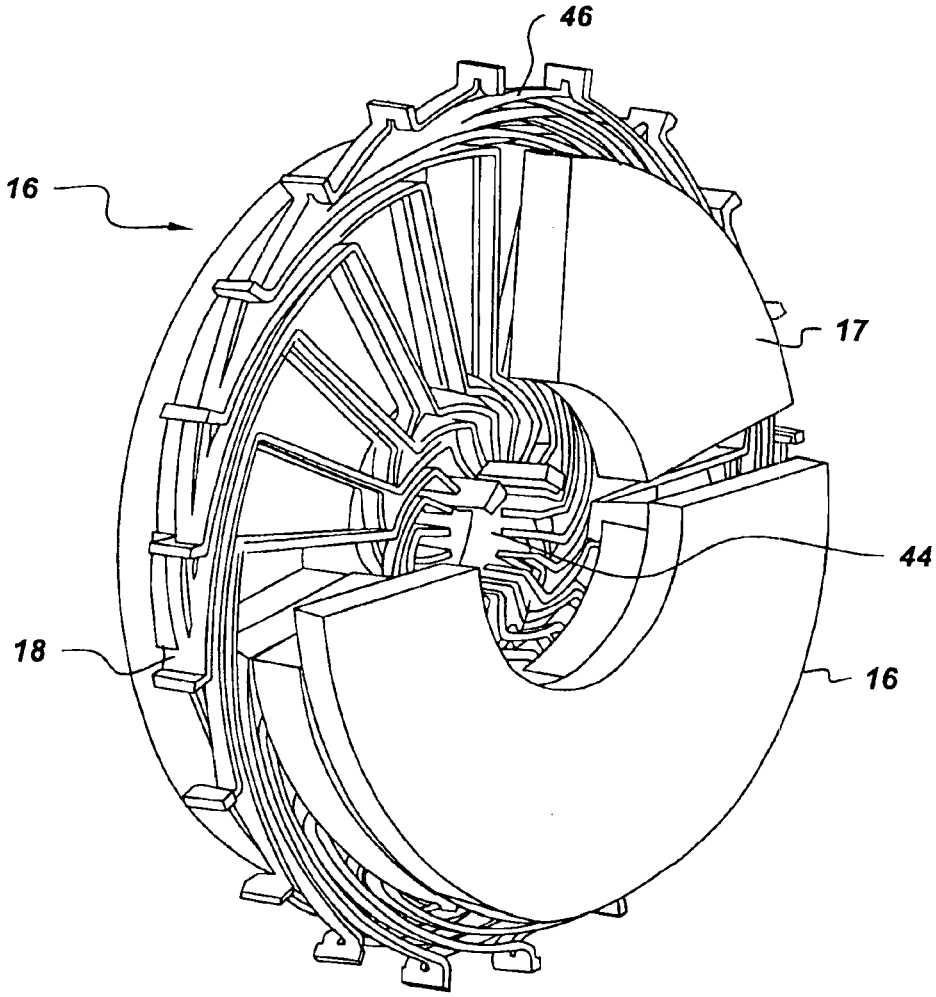
FIG. 7 is an exemplary exploded view showing an axial flux motor assembly.
Figure 8:
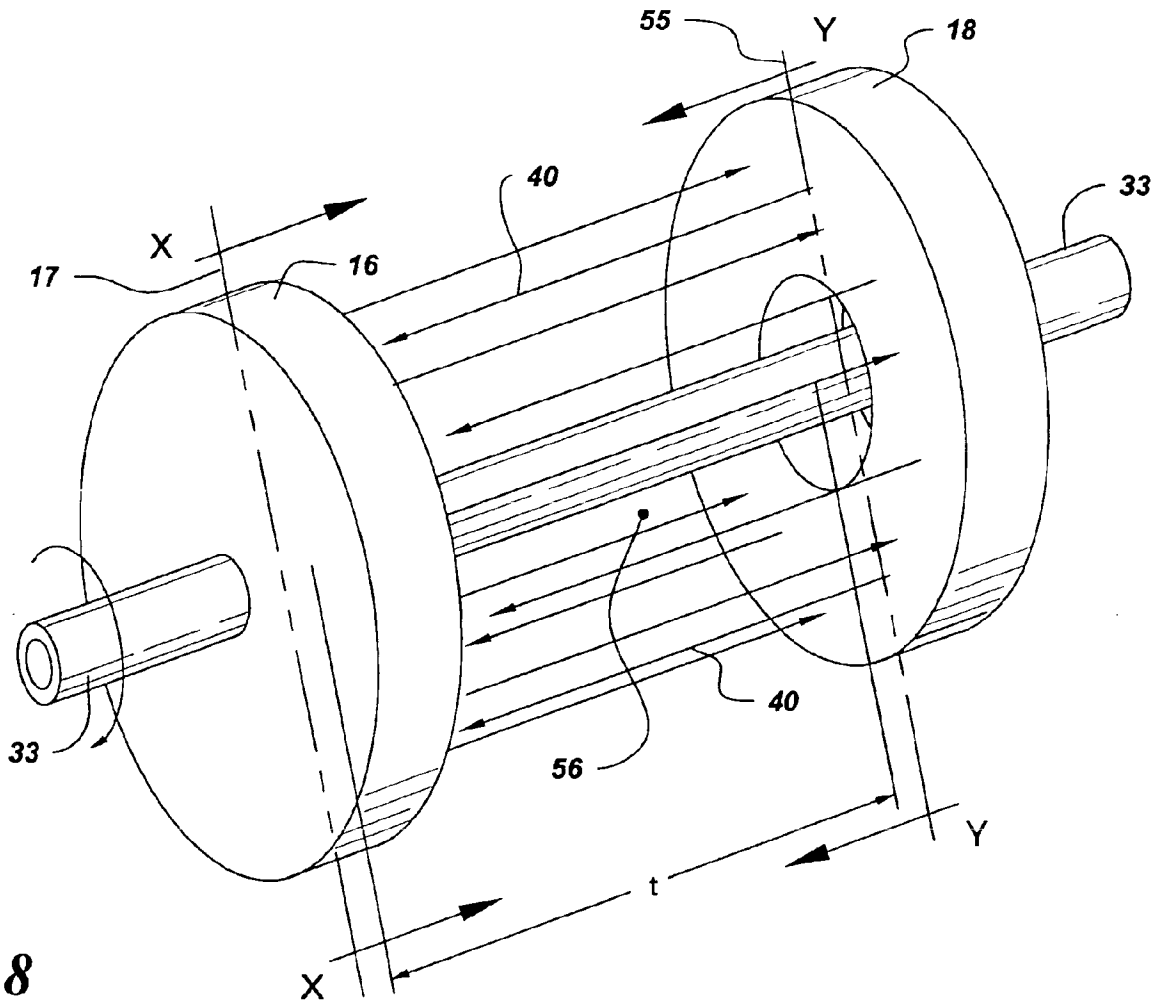
FIG. 8 is a perspective view showing an exemplary arrangement of the rotor and a stator of the axial flux motor assembly according to one embodiment of the invention.

FIG. 7 depicts an exemplary exploded view of the axial flux motor 14, driving the rotor 16 coupled with the anode target assembly 12 of the X-ray tube 10. Such axial flux motors 14 are also sometimes referred as "disk motors" or "pancake motors." As depicted in FIG. 7, overall configuration of such axial flux motors 14 is characterized by typical disk shaped geometry. Operational advantages of using such axial flux motors 14 compared to conventional radial flux motors include, without limitation, enhanced power density, improved compactness, ease of maintenance and improved operational efficiency.

In a particular embodiment, such axial flux motors 14 driving the rotor 16 coupled with the anode target assembly 12 of the X-ray tube 10 include an induction motor. Certain exemplary embodiments pertaining to such axial flux motors 14 include, but are not limited to, an induction motor, a hysteresis motor, a hysteresis-induction motor, a switched-reluctance motor, a synchronous-reluctance motor and a permanent-magnet motor. In operation, selecting such axial flux motors 14 for drive arrangement of the X-ray tube 10 depend on a trade-off relationship among certain factors, for example, output torque, efficiency and manufacturing limitations thereof.

As depicted further in FIG. 1 through FIG. 6, the X-ray tube 10 having the anode target, assembly 12 driven by the axial flux motor 14 typically includes a bearing assembly 24 to support the rotor 16 coupled with the anode target assembly 12. The bearing assembly 24 further includes a first bearing 26, a second bearing 28 and at least one bearing mount 30 for securing the bearings 26, 28. The bearings 26, 28 are spaced apart from each other at a desired span "L" (designated by reference numeral 65). Certain exemplary embodiments pertaining to such bearings 26, 28 include, but are not limited to, a rolling element bearing, a journal bearing and an electromagnetic bearing. The bearings 26, 28 are selected depending on factors, such as, for example, overall thermo-mechanical load induced thereon, rotational speed of the drive arrangement, expected operating life of the bearings and nature of operating environment. The bearings are exposed to a substantial thermal load, particularly due to impingement of the accelerated electron beam 42 on the anode target assembly 12.

Figure 2:
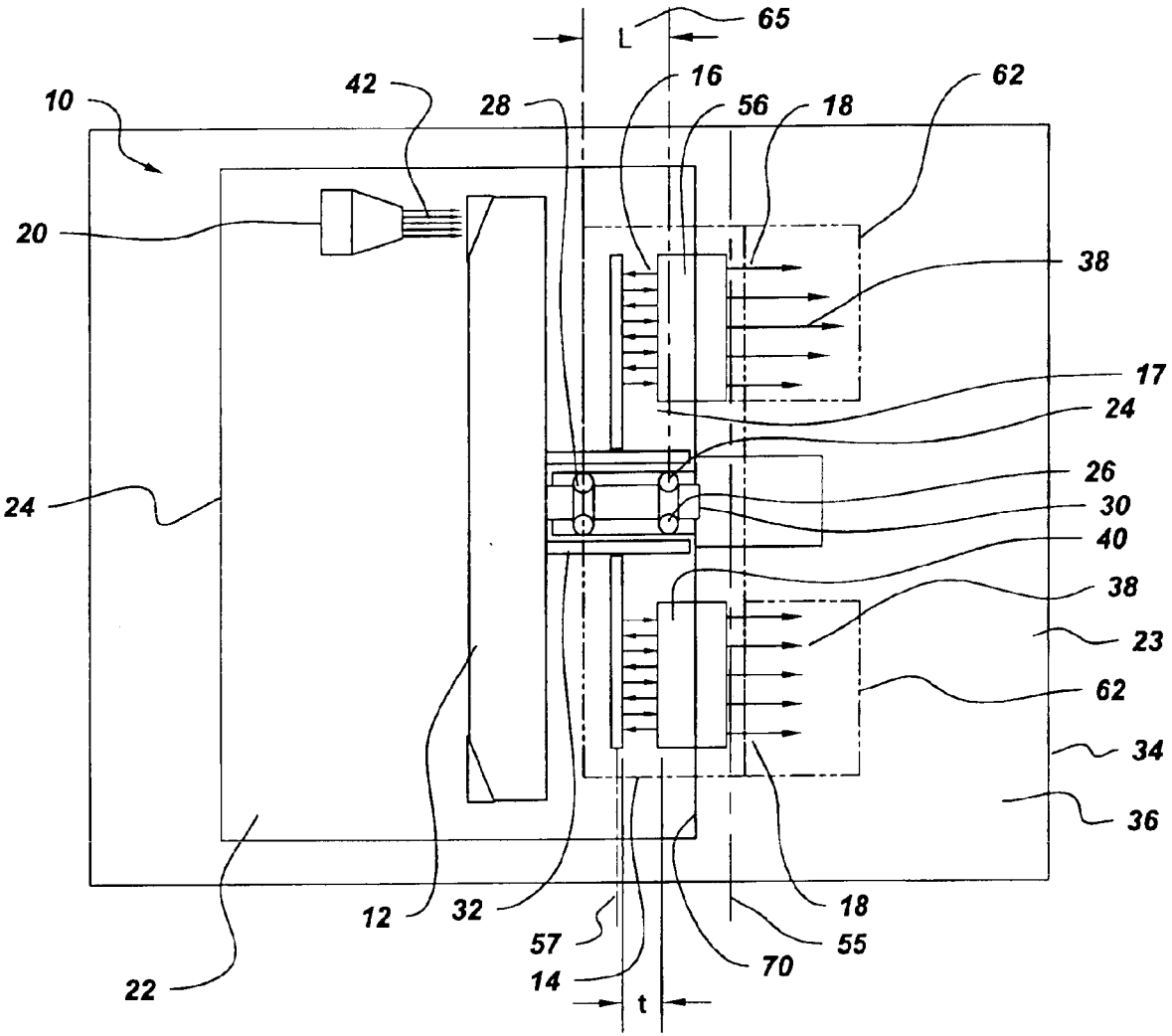
FIG. 2 is an exemplary arrangement of the X-ray tube showing the anode target assembly driven by the axial flux motor according to another embodiment of the invention.

In a particular embodiment depicted in FIG. 1 and FIG. 2, the bearings 26, 28 in the X-ray tube 10 are protected from such thermal load to a certain extent, due to thermal impedance of the mechanical coupling 32 between the rotor 16 and the anode target assembly. In other embodiment depicted in FIG. 3 through FIG. 6, mechanical coupling between the rotor 16 and the anode target assembly 12 includes an arrangement to transmit the torque generated by the axial flux motor 14 to the anode target assembly 12, such as a shaft 33 for example. In such arrangements, thermal impedance of the shaft 33 protects the bearings 26, 28 from the thermal load to a certain extent. As may be appreciated by those skilled in the art, thermal impedance of the shaft 33 may be enhanced by various other possible techniques, for example, by providing a machined hollow passage 60 through the shaft 33 to facilitate dissipation of thermal energy therethrough (see FIG. 5 and FIG. 6). In operation, the bearings 26, 28 are generally disposed in a vacuum environment and experience operating temperature for example in the range of about 300° C. to about 400° C. Hence, lubricants for such bearings 26, 28 desirably include a typically dry lubricant, such as silver, for example, among other materials known in the related art.

FIG. 1 through FIG. 6 depict certain other embodiments of the X-ray tube 10 design having a drive arrangement employing the axial flux motor 14. For example, in certain X-ray tube designs it is operationally desirable to maintain the stator 18 and the anode target assembly 12 at different potential level. In such X-ray tube designs, width "t" of the gap 56 defined by the rotor 16 and the stator 18 is desirably maintained at a value greater than about 10 mm for example, to achieve effective electrical isolation of the axial flux motor 14 from the anode target assembly 12. Under such circumstances, it is desirable to position the stator 18 outside the vacuum housing 22 (see FIG. 2, FIG. 3 and FIG. 6). On the other hand for certain other X-ray tube designs, it is desirable to maintain the stator 18 and the anode target assembly 12 at the same potential level. In such other X-ray tube designs, width "t" of the gap 56 defined by the rotor 16 and the stator 18 should desirably be minimized without affecting electrical isolation of the axial flux motor assembly 14 from the anode target assembly 12. Under such circumstances, the stator 18 is desirably positioned within the vacuum housing 22 (see FIG. 1, FIG. 4 and FIG. 5).

Additionally, these alternative embodiments for positioning the stator 18 with respect to the vacuum housing 22 has impact on a stator cooling system 62 design to address thermal management related issues of the axial flux motor 14. Such stator cooling systems 62 desirably remove a heat flux 38 from the stator winding 46. Pertaining to the X-ray tube designs having the stator 18 desirably positioned outside the vacuum housing 22 (depicted in FIG. 2, FIG. 3, and FIG. 6), an embodiment of the stator cooling system 62 includes combination of a conductive cooling system through the walls 70 of vacuum housing 22 and a convective cooling system through oil 36 surrounding the vacuum housing 22. Pertaining to other X-ray tube designs having the stator 18 desirably positioned outside the vacuum housing 22 (depicted in FIG. 1, FIG. 4, and FIG. 5), other embodiment of the stator cooling system 62 includes a convective cooling system through oil 36 surrounding the vacuum housing 22.

Other embodiments of the X-ray tube 10 are envisaged based on desirable relative position of the stator 18 with respect to location of the vacuum housing 22 as well as alternative configurations pertaining to relative position of the anode target assembly 12 with respect to location of the bearings 26, 28. In an embodiment depicted in FIG. 1 and FIG. 2, the anode target assembly 12 is positioned before the first bearing 26 and the second bearing 28. In one alternative embodiment depicted in FIG. 1, the stator 18 of the axial fluxmotor 14 is positioned within the vacuum housing 22. In other alternative embodiment depicted in FIG. 2, the stator 18 of the axial flux motor 14 is positioned outside the vacuum housing 22.

Figure 3:
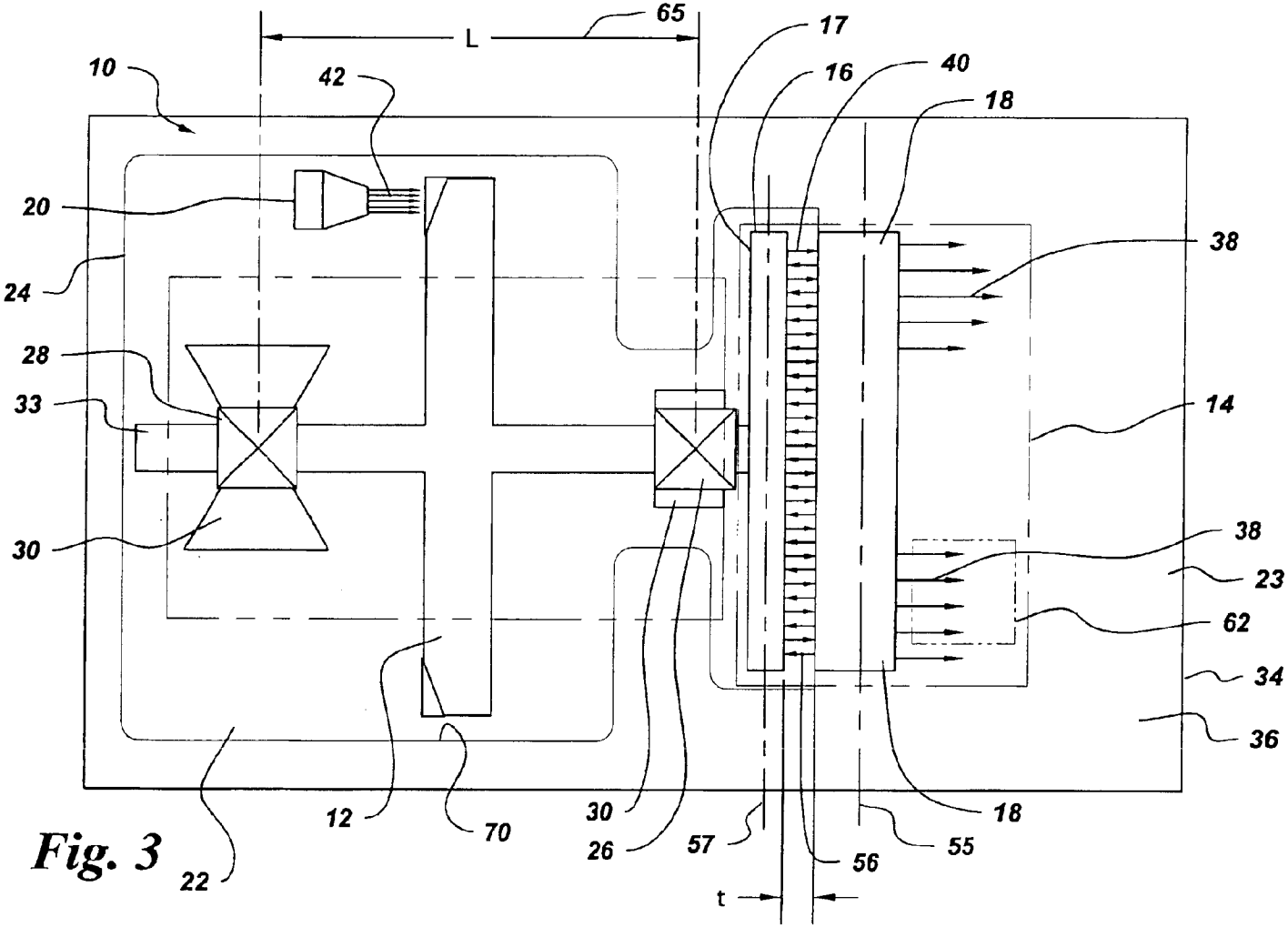
FIG. 3 is an exemplary arrangement of the X-ray tube showing the anode target assembly driven by the axial flux motor according to another embodiment of the invention.
Figure 4:
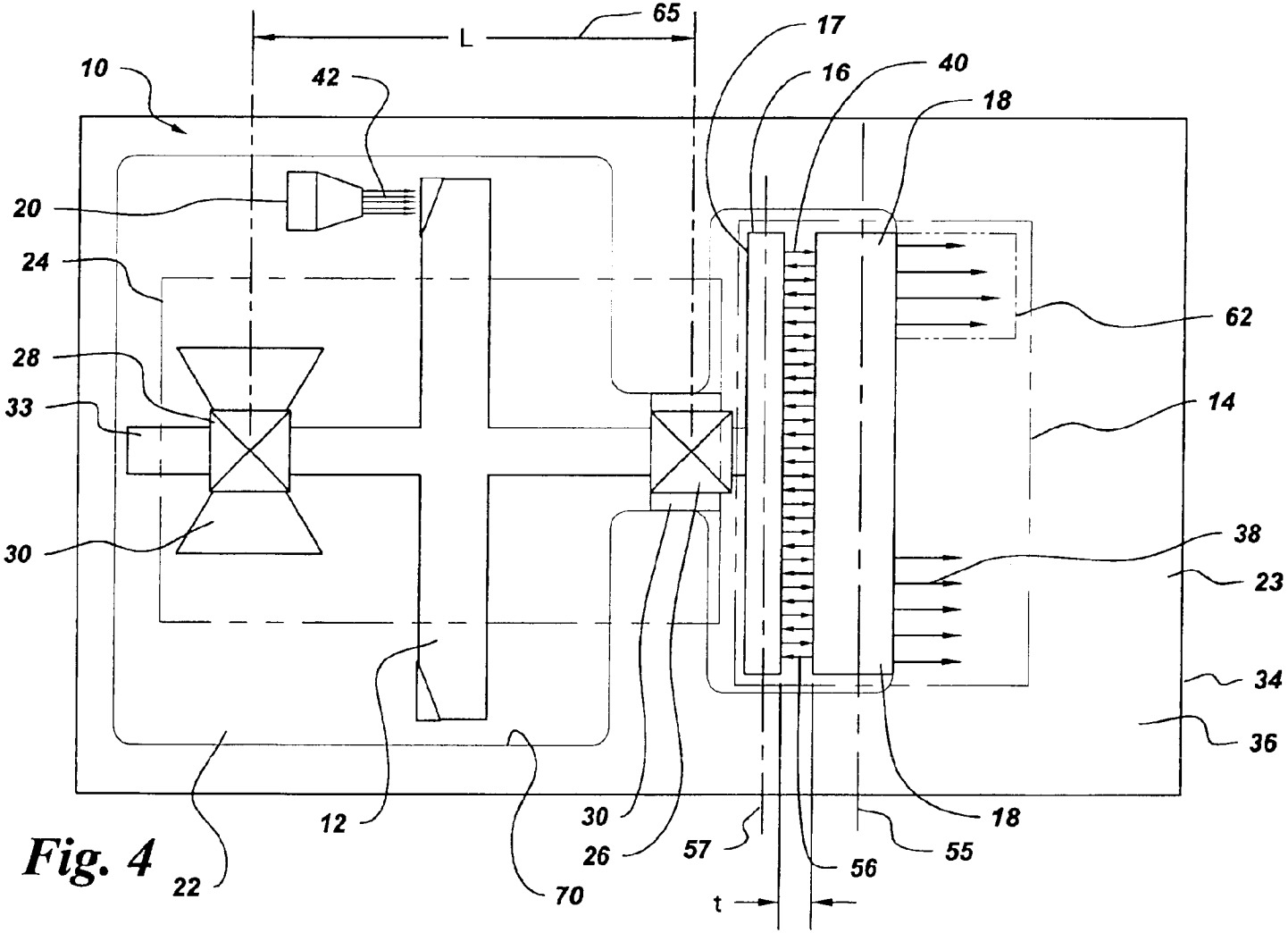
FIG. 4 is an exemplary arrangement of the X-ray tube showing the anode target assembly driven by the axial flux motor according to another embodiment of the invention.

In another embodiment depicted in FIG. 3 and FIG. 4, the anode target assembly 12 is positioned between the first bearing 26 and the second bearing 28. In one alternative embodiment depicted in FIG. 3, the stator 18 of the axial flux motor 14 is positioned outside the vacuum housing 22. In other alternative embodiment depicted in FIG. 4, the stator 18 of the axial flux motor 14 is positioned inside the vacuum housing 22.

Figure 5:
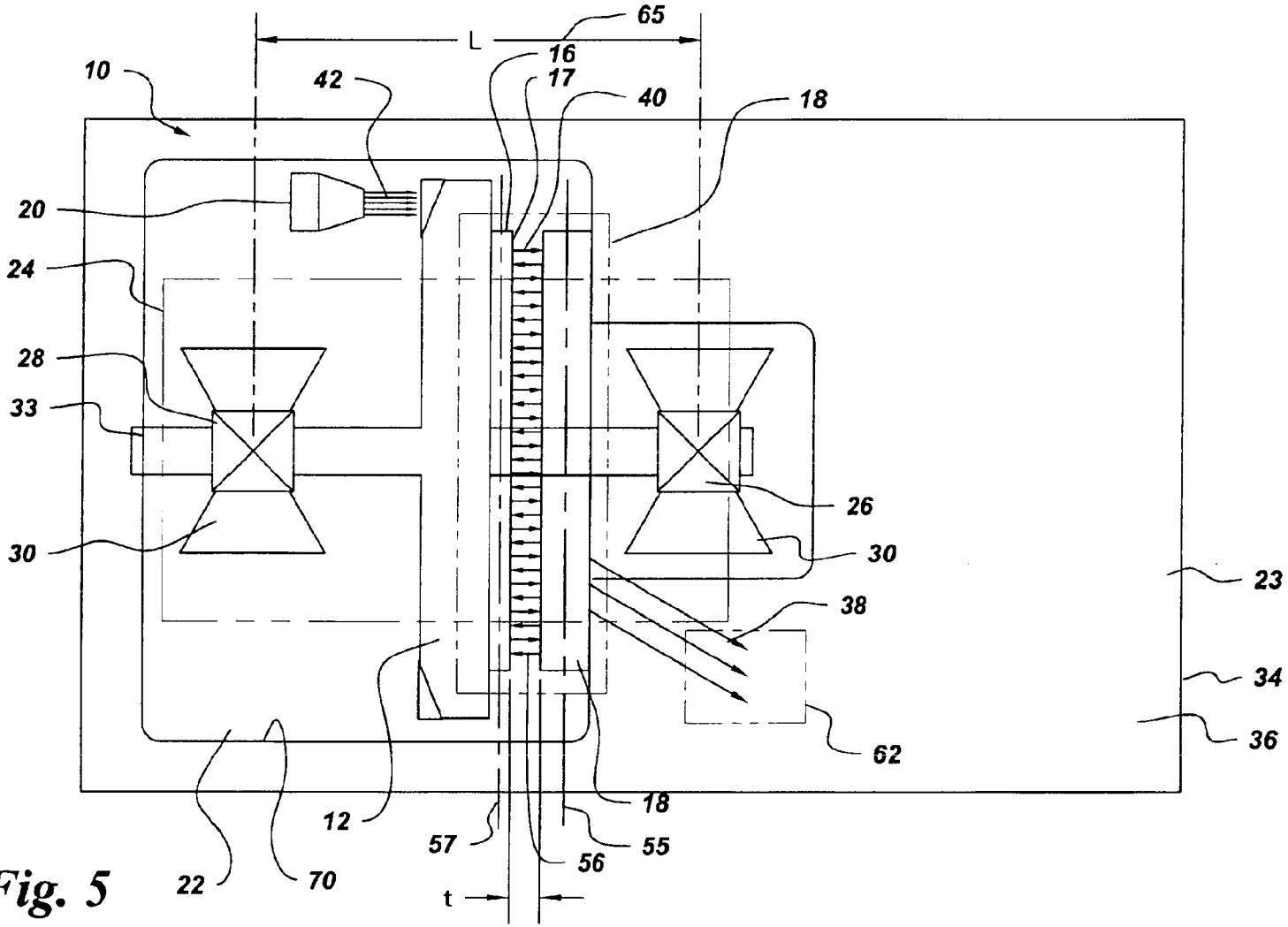
FIG. 5 is an exemplary arrangement of the X-ray tube showing the anode target assembly integral with the rotor of the axial flux motor according to one embodiment of the invention.
Figure 6:
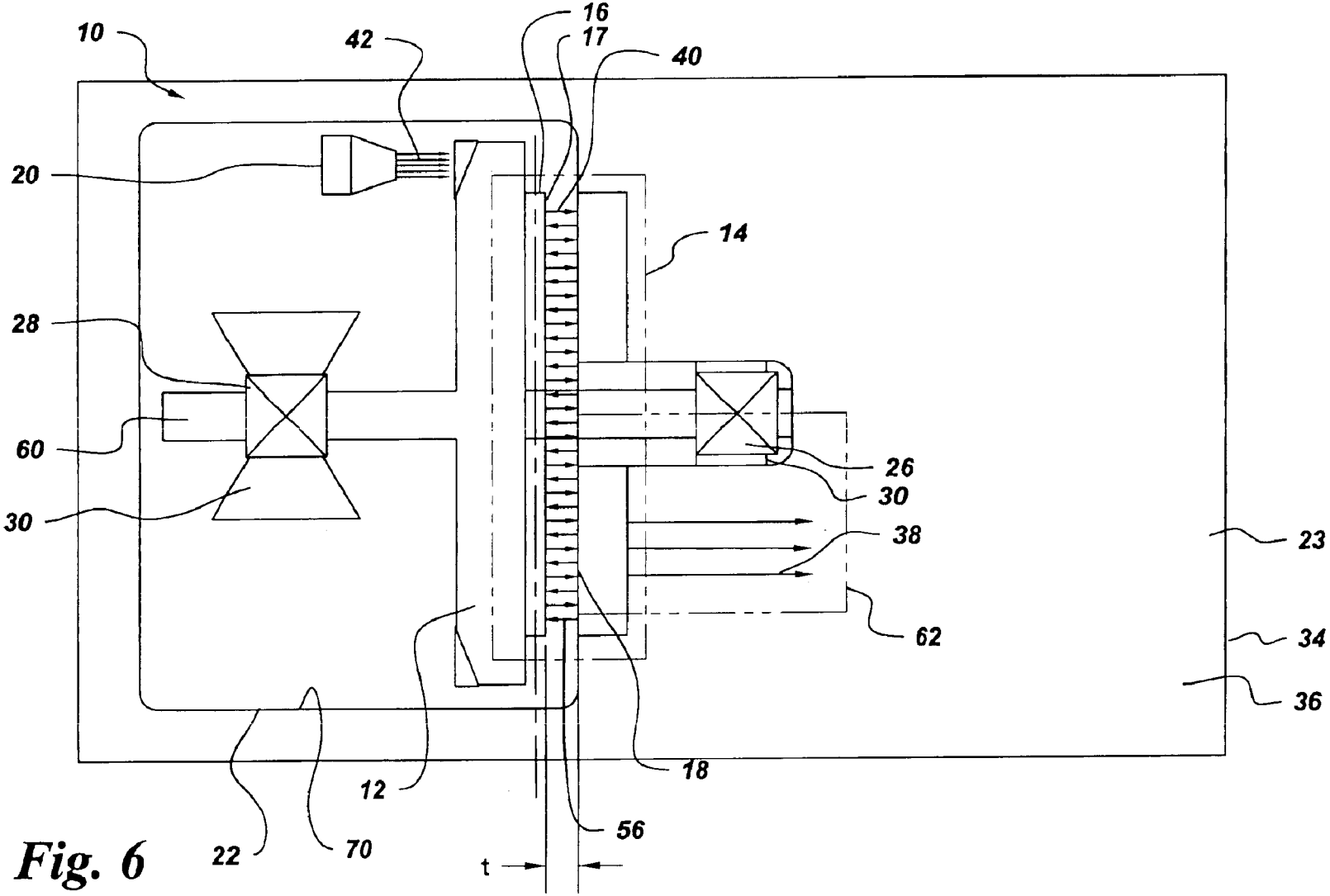
FIG. 6 is an exemplary arrangement of the X-ray tube showing the anode target assembly integral with the rotor of the axial flux motor according to another embodiment of the invention.

In another embodiment depicted in FIG. 5 and FIG. 6, the anode target assembly 12 is integral with the rotor 16 of the axial flux motor 14 while positioned between the first bearing 26 and the second bearing 28. In one alternative embodiment depicted in FIG. 5, the stator 18 of the axial flux motor 14 is positioned inside the vacuum housing 22. In other alternative embodiment depicted in FIG. 6, the stator 18 of the axial flux motor 14 is positioned outside the vacuum housing 22.

Overall mass distribution of the axial flux motor 14 being characterized by typically "disk-shaped" configuration depicted in FIG. 7, has advantageous effects in minimizing overall static and dynamic load experienced by the bearings 26, 28 supporting the rotating components of the X-ray tube 10 such as, for example, rotor 16 and the anode target assembly 12. Minimizing overall static load and dynamic load on the bearings 26, 28 enhances bearing life. Enhanced bearing life ensures improved static and dynamic stability of the X-ray tube 10 in operation. As a consequence, significant benefit is derived from achieving maximum uninterrupted operating hours of the X-ray generation system, to improve overall system reliability thereof.

Another significant advantage of using such "disk-shaped" axial flux motor 14 to drive the anode target assembly of the X-ray tube 10 includes, substantial minimization of the span length "L" (designated by reference numeral 65) between the bearings 26, 28, without compromising balance of static and dynamic load distribution between the first bearing 26 and the second bearing 28. Minimizing span length "L" between the bearings 26, 28 beneficially improves overall compactness of the X-ray tube 10 accordingly.

Some other embodiments of the rotor 16 may be envisioned to generally improve operational effectiveness of the axial flux motor 14. In one embodiment, the rotor 16 includes a disc 17 (see FIG. 1 through FIG. 12). In a particular embodiment, the disc 17 is fabricated from a ferromagnetic material such as a cobalt steel alloy for example. Such ferromagnetic materials are characterized by "residual magnetism" due to typical "hystereis-effect" under cyclic magnetic field applied thereupon. Such "hysteresis-effect" demonstrated by the ferromagnetic materials has beneficial impact towards augmenting output torque of the axial flux motor 14.

Figure 9:
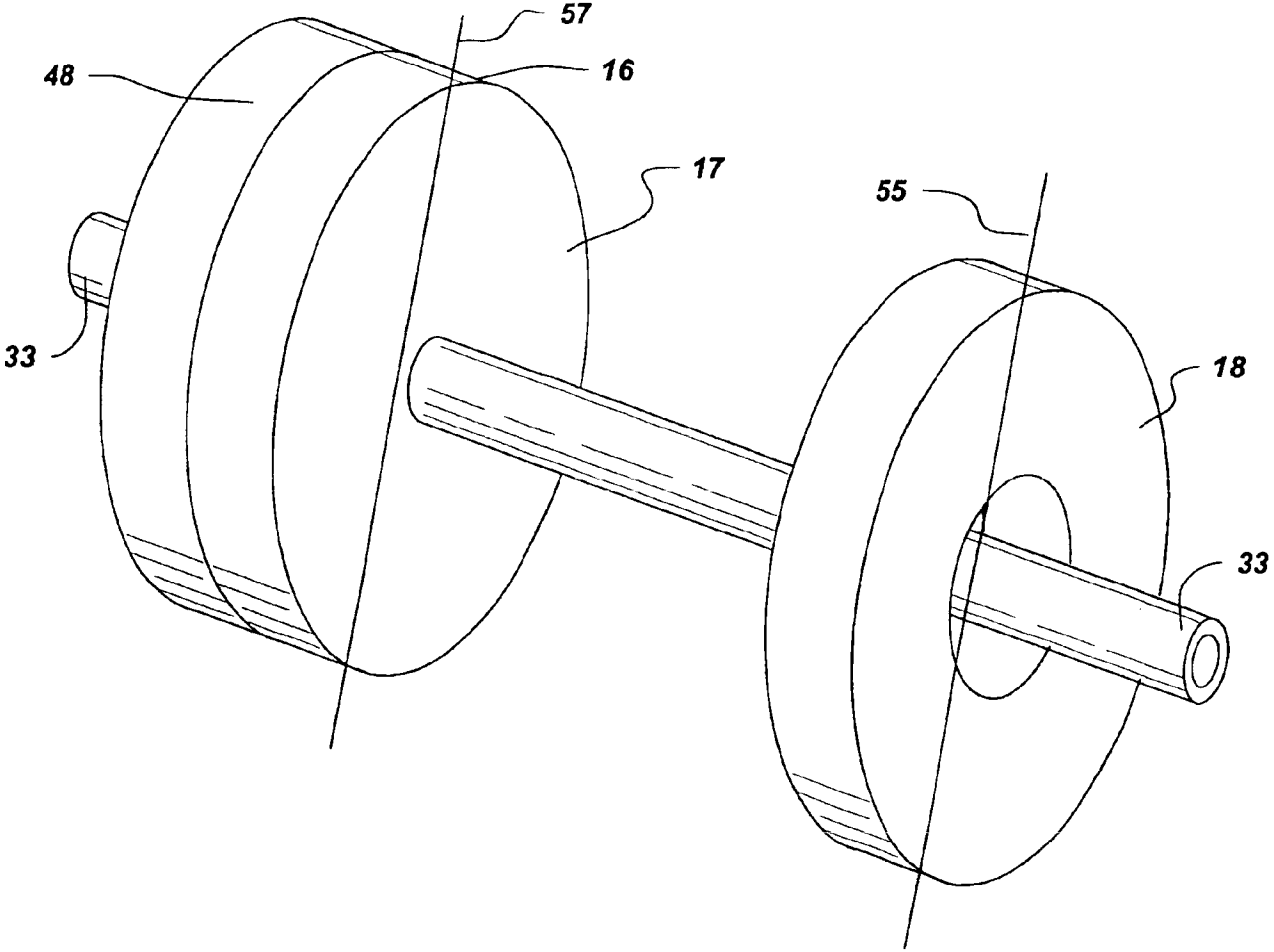
FIG. 9 is a perspective view showing an arrangement of the rotor of the axial flux motor assembly according to one embodiment of the invention.
Figure 10:
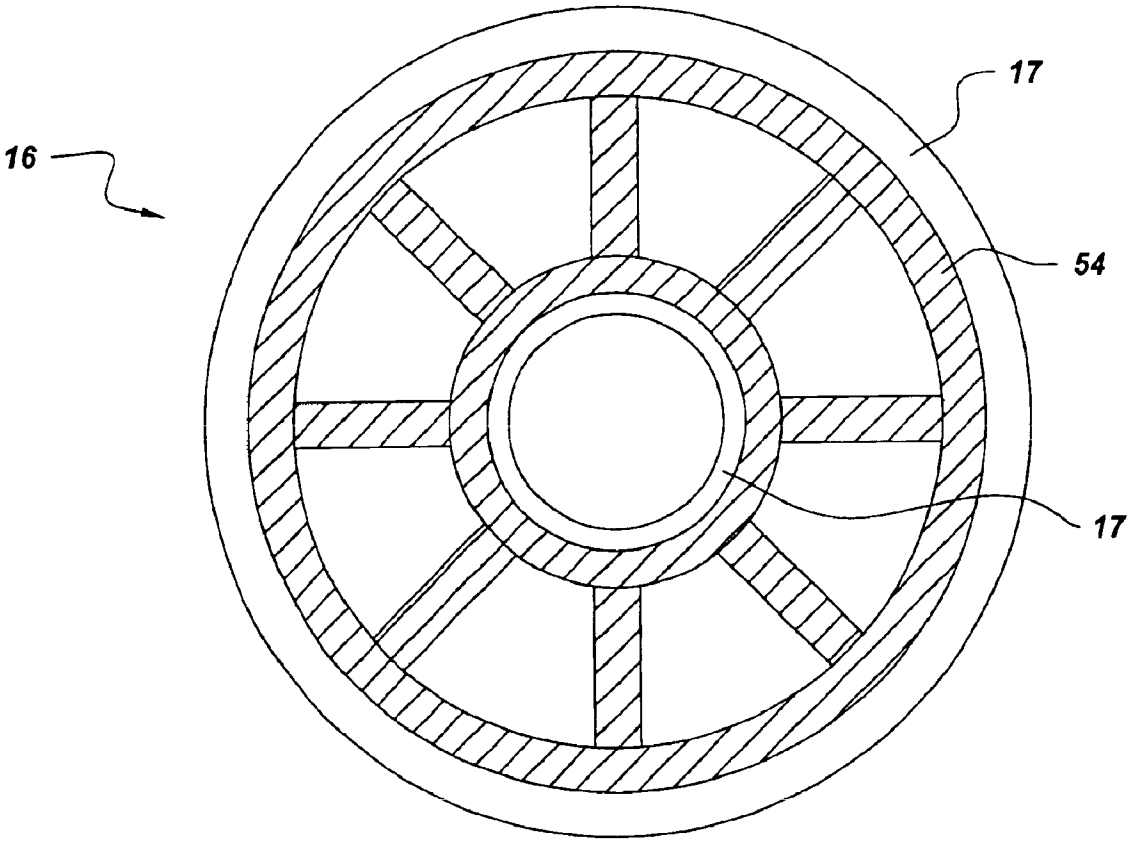
FIG. 10 is a sectional view along section X—X of FIG. 8 showing another arrangement of the rotor of the axial flux motor assembly according to one embodiment of the invention.

In another embodiment depicted in FIG. 9, the disc 17 is coupled to a second disc 48. In an alternative embodiment depicted in FIG. 10, the disc 17 is coupled to a cage 54. The second disc 48 as well as the cage 54 material includes either copper or nano-particles of aluminum oxide dispersed in a copper matrix so as to enhance electromagnetic conductance of the rotor 16. Additionally, nano-particles of aluminum oxide dispersed in the copper matrix enhance mechanical strength as well as thermal stability of the rotor 16 without substantially degrading electrical conductivity thereof.

Figure 11:
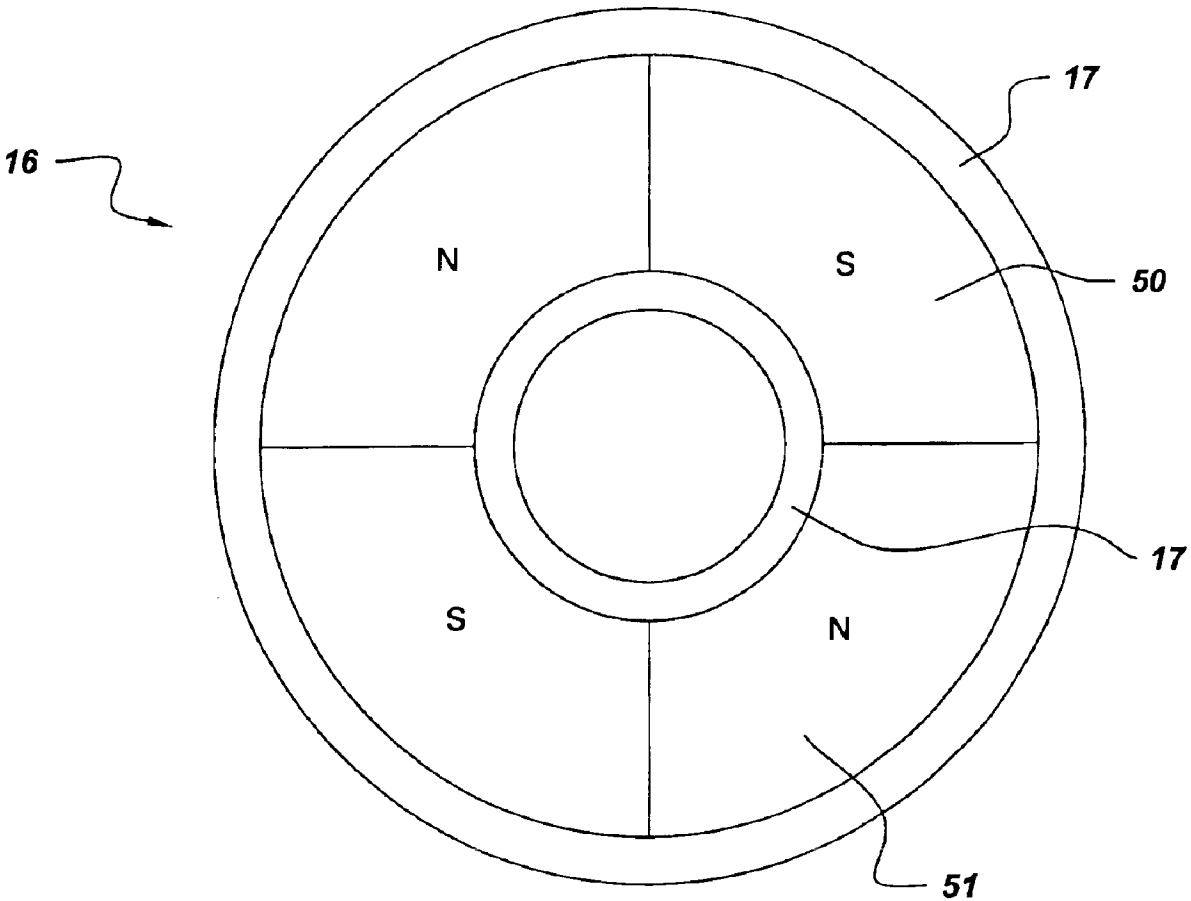
FIG. 11 is a sectional view along section X—X of FIG. 8 showing another arrangement of the rotor of the axial flux motor assembly according to another embodiment of the invention.

In another embodiment depicted in FIG. 11, the disc 17 is coupled to a permanent magnet 50. In certain alternative embodiments, the permanent magnet 50 is constructed of a plurality of magnets 51 positioned circumferentially around the disc 17. Such configuration, characterized by the plurality of magnets 51 enhances control over distribution of the magnetic flux 40 across the gap 56. Enhanced control over distribution of the magnetic flux 40 across the gap 56 improves electromagnetic performance of the axial flux motor assembly 14 further.

Figure 13:
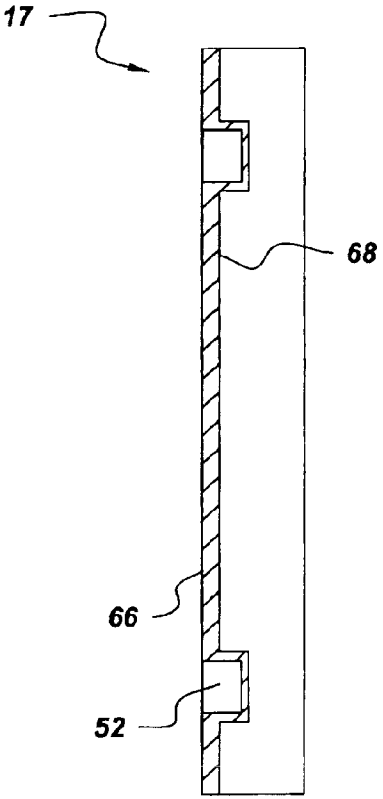
FIG. 13 is a sectional view along section Y—Y of FIG. 12 depicting further details of the embodiment illustrated in FIG. 13
Figure 12:
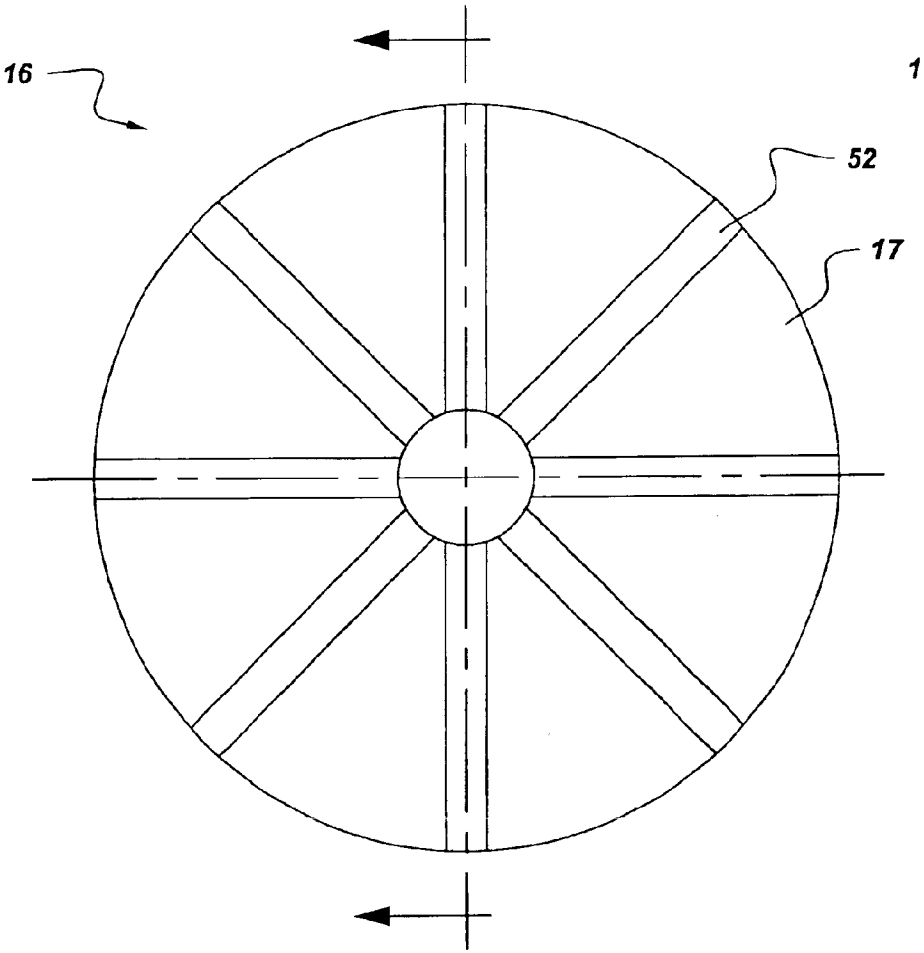
FIG. 12 is a sectional view along section X—X of FIG. 8 showing another arrangement of the rotor of the axial flux motor assembly according to another embodiment of the invention.

In another embodiment depicted in FIG. 12, the disc 17 is characterized by a plurality of radial grooves 52. Such radial grooves 52 advantageously minimize density of eddy current 68 adjacent to the upper surface or "skin" 66 of the disc 17 (see FIG. 13). Minimizing density of eddy current 68 adjacent to the "skin " 66 of the disc 17 ensures minimal electromagnetic interference of the eddy current 68 with the magnetic flux 40 induced in the gap 56, improving overall operational performance of the axial flux motor 14 thereby. In addition, such radial grooves 52 aid in dissipating thermal energy generated in the rotor 16 ensuring it's the thermal stability of the rotor accordingly.

FIG. 7, also depicts the constructional aspect of stator 18 of the axial flux motor 14. As shown in FIG. 7, the stator 18 is constructed of a stator core 44 and a stator winding 46. In one embodiment, the stator core 44 is built from a plurality of laminations (not shown). Such laminations are fabricated from materials, for example, magnetic iron having an insulating film disposed on at least one surface thereof for minimizing eddy currents circulating therethrough. In other embodiment, the stator core 44 is built from annealable iron powder to minimize stator core loss substantially. In addition, such stator core 44 built from annealable iron powder has significant impact towards augmenting output torque to weight ratio of the axial flux motor 14. Typically, it is a desirable manufacturing practice in the related art to perform annealing of the stator core 44 of the axial flux motor 14 after it is assembled with the stator winding 46. Hence, the stator winding 46 should desirably withstand temperatures for annealing and degassing of the stator core 44, in the range from about 400° C. to about 800° C., for example. Exemplary stator winding 46 material capable of withstanding such temperature range typically include, mica-glass composites, among other materials known in the related art. Certain exemplary embodiments pertaining to the stator winding 46 of such axial flux motors 14 include, but are not limited to, a distributed winding, a concentrated winding and a slot-less winding. In general, choice of such stator windings 46 is determined by a trade-off relationship among certain factors such as, for example, electromagnetic performance of the axial flux motor 14, output torque and ease in manufacturing aspects thereof.

It will be apparent to those skilled in the art that, although the invention has been illustrated and described herein in accordance with the patent statutes modification and changes may be made to the disclosed embodiments without departing from the true spirit and scope of the invention. It is, therefore, to be understood that the appended claims are intended to cover all such modifications and changes as fall within the true spirit and scope of the invention.

What is claimed is:

1. An X-ray tube comprising:

an anode target assembly;

an axial flux motor having a rotor and a stator, said stator positioned along a transverse axis parallel to said rotor axis, said rotor and said stator coupled to said anode target assembly;

a cathode for generating an electron beam for impingement upon said anode target assembly; and a vacuum housing surrounding said anode target assembly, said cathode and said rotor to enable said electron beam impingement.

2. The X-ray-tube in accordance with claim 1, wherein said axial flux motor further comprises a bearing assembly to support said rotor coupled to said anode target assembly.

3. The X-ray tube in accordance with claim 2, wherein said bearing assembly comprises at least two bearings and at least one bearing mount.

4. The X-ray tube in accordance with claim 3, wherein said anode target assembly is positioned between at least a first bearing and a second bearing of said at least two bearings.

5. The X-ray tube in accordance with claim 3, wherein said anode target assembly is positioned before said first bearing and said second bearing of said at least two bearings.

6. The X-ray tube in accordance with claim 3, wherein said at least two bearings are selected from the group consisting of a rolling element bearing, a journal bearing and an electromagnetic bearing.

7. The X-ray tube in accordance with claim 3, wherein said at least two bearings are configured to be dry lubricated.

8. The X-ray tube in accordance with claim 2, wherein said rotor is further configured to be integral with said anode target assembly.

9. The X-ray tube in accordance with claim 1, wherein said axial flux motor is selected from the group consisting of an induction motor, a hysteresis motor, a hysteresis-induction motor, a switched-reluctance motor, a synchronous-reluctance motor and a permanent-magnet motor.

10. The X-ray tube in accordance with claim 1, wherein said axial flux motor comprises an induction motor.

11. The X-ray tube in accordance with claim 1, wherein said stator comprises a stator core and a stator winding.

12. The X-ray tube in accordance with claim 11, wherein said stator core material comprises annealable iron powder.

13. The X-ray tube in accordance with claim 11, wherein said stator winding is configured to withstand a temperature in the range from about 400° C. to about 800° C.

14. The X-ray tube in accordance with claim 11, wherein said stator winding comprises at least one of a distributed winding, a concentrated winding and a slot-less winding.

15. The X-ray tube in accordance with claim 11, wherein said stator winding further comprises a stator cooling system.

16. The X-ray tube in accordance with claim 15, wherein said stator cooling system is selected from at least one of a conductive cooling system, a convective cooling system and combination thereof.

17. The X-ray tube in accordance with claim 16, wherein said disc comprises a ferromagnetic material.

18. The X-ray tube in accordance with claim 17, wherein said second disc material comprises at least one of copper or aluminum oxide dispersed copper.

19. The X-ray tube in accordance with claim 1, wherein said stator is disposed within said vacuum housing.

20. The X-ray tube in accordance with claim 1, wherein said stator is disposed outside said vacuum housing.

21. The X-ray tube in accordance with claim 1, wherein said rotor comprises a disc.

22. The X-ray tube in accordance with claim 21, wherein said disc is spaced apart from said anode target assembly by a mechanical coupling and a thermal impedance.

23. The X-ray tube in accordance with claim 21, wherein said disc further comprises radial grooves.

24. The X-ray tube in accordance with claim 21, wherein said disc is configured to be coupled to a second disc.

25. The X-ray tube in accordance with claim 21, wherein said disc is configured to be coupled to a cage.

26. The X-ray tube in accordance with claim 25, wherein said cage material comprises at least one of copper or aluminum oxide dispersed copper.

27. The X-ray tube in accordance with claim 21, wherein said disc is configured to be coupled to a permanent magnet.

28. An X-ray tube comprising:

an anode target assembly;

an axial flux induction motor having a rotor and a stator, said rotor comprising a ferromagnetic disc, said stator positioned along a transverse axis parallel to said rotor axis, said rotor and said stator coupled to said anode target assembly, said axial flux induction motor further comprising a bearing assembly having at least two bearings and at least one bearing mount to support said rotor; said anode target assembly being positioned before a first bearing and a second bearing of said at least two bearings;

a cathode for generating an electron beam for impingement upon said anode target assembly; and a vacuum housing surrounding said anode target assembly, said cathode and said rotor to enable said electron beam impingement; wherein said stator is positioned within said vacuum housing.

29. The X-ray tube in accordance with claim 28, wherein said at least two bearings are selected from the group consisting of a rolling element bearing, a journal bearing and an electromagnetic bearing.

30. The X-ray tube in accordance with claim 28, wherein said stator comprises a stator core and a stator winding.

31. The X-ray tube in accordance with claim 30, wherein said stator core material comprises annealable iron powder.

32. The X-ray tube in accordance with claim 31, wherein said stator winding comprises at least one of a distributed winding, a concentrated winding and a slot-less winding.

33. The X-ray tube in accordance with claim 28, wherein said disc is configured to be coupled to a second disc.

34. The X-ray tube in accordance with claim 33, wherein said second disc material comprises at least one of copper or aluminum oxide dispersed copper.

35. The X-ray tube in accordance with claim 28, wherein said disc is configured to be coupled to a permanent magnet.

36. An X-ray tube comprising:

an anode target assembly;

an axial flux induction motor having a rotor and a stator, said rotor comprising a ferromagnetic disc, said stator positioned along a transverse axis parallel to said rotor axis, said rotor and said stator coupled to said anode target assembly, said axial flux induction motor further comprising a bearing assembly having at least two bearings and at least one bearing mount to support said rotor; said anode target assembly being positioned before a first bearing and a second bearing of said at least two bearings;

a cathode for generating an electron beam for impingement upon said anode target assembly; and a vacuum housing surrounding said: anode target assembly, said cathode and said rotor to enable said electron beam impingement; wherein said stator is positioned outside said vacuum housing.

37. The X-ray tube in accordance with claim 36, wherein said at least two bearings are selected from the group consisting of a rolling element bearing, a journal bearing and an electromagnetic bearing.

38. The X-ray tube in accordance with claim 36, wherein said stator comprises a stator core and a stator winding.

39. The X-ray tube in accordance with claim 38, wherein said stator winding comprises at least one of a distributed winding, a concentrated winding and a slot-less winding.

40. An X-ray tube comprising:

an anode target assembly;

an axial flux induction motor having a rotor and a stator, said rotor comprising a ferromagnetic disc, said stator positioned along a transverse axis parallel to said rotor axis, said rotor and said stator coupled to said anode target assembly, said axial flux induction motor further comprising a bearing assembly having at least two bearings and at least one bearing mount to support said rotor; said anode target assembly being positioned between at least a first bearing and a second bearing of said at least two bearings;

a cathode for generating an electron beam for impingement upon said anode target assembly; and a vacuum housing surrounding said anode target assembly, said cathode and said rotor to enable said electron beam impingement; wherein said stator is positioned within said vacuum housing.

41. The X-ray tube in accordance with claim 40, wherein said at least two bearings are selected from the group consisting of a rolling element bearing, a journal bearing and an electromagnetic bearing.

42. The X-ray tube in accordance with claim 40, wherein said stator comprises a stator core and a stator winding.

43. The X-ray tube in accordance with claim 42, wherein said stator core material comprises annealable iron powder.

44. The X-ray tube in accordance with claim 42, wherein said stator winding comprises at least one of a distributed winding, a concentrated winding and a slot-less winding.

45. An X-ray tube comprising:

an anode target assembly;

an axial flux induction motor having a rotor and a stator, said rotor comprising a ferromagnetic disc, said stator positioned along a transverse axis parallel to said rotor axis, said rotor and said stator coupled to said anode target assembly, said axial flux induction motor further comprising a bearing assembly having at least two bearings and at least one bearing mount to support said rotor; wherein said anode target assembly is positioned between at least a first bearing and a second bearing of said at least two bearings;

a cathode for generating an electron beam for impingement upon said anode target assembly; and a vacuum housing surrounding said anode target assembly, said cathode and said rotor to enable said electron beam impingement; wherein said stator is positioned outside said vacuum housing.

46. The X-ray tube in accordance with claim 45, wherein said at least two bearings are selected are selected from the group consisting of a rolling element bearing, a journal bearing and an electromagnetic bearing.

47. The X-ray tube in accordance with claim 45, wherein said stator comprises a stator core and a stator winding.

48. The X-ray tube in accordance with claim 47, wherein said stator winding comprises at least one of a distributed winding, a concentrated winding and a slot-less winding.

49. An X-ray tube comprising:

an anode target assembly;

an axial flux induction motor having a rotor and a stator, said stator positioned along a transverse axis parallel to said rotor axis; wherein said rotor further integral with said anode target assembly, said axial flux induction motor further comprising a bearing assembly having at least two bearings and at least one bearing mount to support said anode target assembly, said anode target assembly being positioned between at least a first bearing and a second bearing of said at least two bearings;

a cathode for generating an electron beam for impingement upon said anode target assembly; and a vacuum housing surrounding said anode target assembly and said cathode to enable said electron beam impingement.

50. The X-ray tube in accordance with claim 49, wherein said at least two bearings are selected are selected from the group consisting of a rolling element bearing, a journal bearing and an electromagnetic bearing.

51. The X-ray tube in accordance with claim 49, wherein said stator is disposed within said vacuum housing.

52. The X-ray tube in accordance with claim 49, wherein said stator is disposed outside said vacuum housing.

* * * * *